United States Patent [19]

Masaki

[11] 4,314,813

[45] Feb. 9, 1982

[54] FLOCK TRANSFER SHEET AND FLOCK TRANSFER PRINTING PROCESS

[76] Inventor: Yasuzi Masaki, No. 11-3, Shin-Ohashi 1-chome, Koto-ku, Tokyo, Japan

[21] Appl. No.: 191,726

[22] Filed: Sep. 29, 1980

[30] Foreign Application Priority Data

Nov. 16, 1979 [JP] Japan ..... 54-148477

[51] Int. Cl.[3] ..... D06P 5/00; B44C 3/02

[52] U.S. Cl. ..... 8/468; 8/471; 8/488; 156/230; 156/234; 156/235; 156/240; 427/148

[58] Field of Search ..... 8/468, 471, 488; 427/148; 156/234, 235

[56] References Cited

U.S. PATENT DOCUMENTS 3,918,895 11/1975 Mizuno ..... 8/468
4,201,810 5/1980 Hisashisuchi ..... 156/234
4,233,027 11/1980 Albero ..... 8/488

FOREIGN PATENT DOCUMENTS

50/52361 5/1975 Japan .
78/35619 9/1978 Japan .
78/36058 9/1978 Japan .

*Primary Examiner*—A. Lionel Clingman
*Attorney, Agent, or Firm*—Paul J. Sutton

[57] ABSTRACT

The present invention provides a flock transfer sheet comprising a base sheet, a pattern layer overlaid on said base sheet and containing a heat-sublimable or heat-vaporizable dye as a main ingredient, a thickener layer overlaid on said pattern layer, a pile layer of short fibers electrostatically overlaid on said thickener layer, and a hot melt adhesive layer formed on said pile layer. Said thickener layer has a multiplicity of gas permeable micropores for allowing the sublimated or vaporized dye to penetrate and pass therethrough while leaving the thickener layer per se undyed. The present invention also provides a flock transfer printing process wherein the aforementioned flock transfer sheet is used to heat transfer the pattern formed by said pile layer to a blank stuff, such as woven or knitted fablics.

28 Claims, 15 Drawing Figures

FLOCK TRANSFER SHEET AND FLOCK TRANSFER PRINTING PROCESS

BACKGROUND OF THE INVENTION

1. Field of the Invention

The present invention relates to a flock transfer sheet and a flock transfer printing process using the aforementioned flock transfer sheet, and more particularly to a flock transfer sheet adapted for transferring a pile layer made of short fibers dyed to form a pattern of single color or multicolor to a blank stuff, such as a textile fabric or other substrate, to be transferred with the pattern and a flock transfer printing process using such a flock transfer sheet.

2. Prior Art

A flock transfer printing process has been known in the art, in which a pile layer is preliminarily formed on a textile fabric by flocking short fibers and then a pattern is directly printed on the thus flocked pile layer by the use of a printing ink containing a pigment or a resin-bonded pigment color for textile printing followed by fixing the pigment to the short fibers of the pile layer by means of a binder to effect coloring. However, the flock printed matter manufactured by this known process and colored with pigments has disadvantages that it is inferior in color fastnesses to rubbing and crocking that the feeling of the printed portions becomes stiffish and that the printed color lacks brightness and deepness.

In order to improve the feeling of the printed portions and to improve the brightness and deepness of the printed color, it has been proposed to dye the pile layer of short fibers preliminarily flocked on a blank textile fabric with the use of dye. However, whatever dyes are used in practical operation of this known process, it is necessary to after-treat the printed matter through additional steaming and rinsing steps which require a complete waste water treating plant to avoid the pollution problems, thus resulting in considerable increase in investment for such facilities.

Japanese Patent Publication No. 35619/1978 discloses another process which comprises the steps of flocking a release paper sheet with short fibers to form a flocked sheet having a pile layer of short fibers, printing a pattern on the thus flocked sheet using a printing ink containing a pigment to form a flock transfer sheet colored with the pigment, applying the thus formed flock transfer sheet closely on a textile fabric to transfer the pile layer on the textile fabric, and then peeling off the release paper sheet from the pile layer to form a flock printed matter. However, according to this known process, the face of the pile layer of short fibers which has contacted with the release paper sheet forms the upside face of the final printed product. Accordingly, it is required that the printing ink containing the pigment penetrates through the pile layer into the surface area of the release paper sheet in order to form a uniform colored pattern. However, if the printing ink is allowed to penetrate into the surface area of the release paper sheet, the printed images forming the pattern become inevitably thickened and obscure to make it impossible to precisely reproduce a fine or halftone pattern with attendant disadvantage that the feeling of the transfer-printed fabric becomes stiffish.

A further sublimation transfer printing process has been known to the art by French Pat. No. 1,223,330, in which the common sublimation printing method is disclosed. As a method utilizing this known process, a flocked sheet is formed by flocking short fibers on a textile fabric in a desired pattern to form a pile layer, and a separate transfer sheet printed with the same desired pattern is prepared using a printing ink containing a heat-sublimable or heat-vaporizable dye. Then, the transfer sheet is overlaid on the flocked sheet while precisely registering the printed pattern of the former with the contour of the flocked portion on the flocked textile fabric and heated under pressure, whereupon the dye contained in the printed ink is sublimated or vaporized to dye the pile layer so that the printed pattern is transferred to the flocked textile fabric to form a flock printed matter. Although the flock printed matter produced by this known process is improved in bright color and comfortable touch or feeling over the products produced by the preceding known processes in which pigments are used, it has a disadvantage in that halo and ghosting phenomena tend to occur at the heat transferring step due to the difference in heat-shrinckage percentage between the transfer sheet and the flocked textile fabric to which the printed pattern is transferred.

I have already proposed a flock transfer printing process for producing a flock printed matter which is excellent in feeling and printed with a multi-colored pattern or image of bright color. (See Japanese Patent Publication No. 36058/1978.) In this process previously proposed by me, short fibers are flocked on a release paper sheet to prepare a flocked sheet forming a pile layer of short fibers. Separately, a transfer pattern is printed on another sheet of paper using a printing ink containing a heat-sublimable or heat-vaporizable dye followed by applying a hot melt adhesive on the exposed face of the transfer pattern formed of the printing ink. Then, the pile layer of the flocked sheet is peeled off from the release paper and overlaid on the transfer sheet to apply one face of the pile layer to the printed pattern born on the transfer sheet through the hot melt adhesive. An adhesive is coated on the other face of the pile layer, to which a textile fabric is applied through the adhesive. Then, the entire laminate structure is heated under pressure to transfer the printed pattern to the pile layer and concurrently to adhere the pile layer to the textile fabric by means of the adhesive. Finally, the sheet of paper used for the base sheet of the transfer sheet is peeled off to produce a finished product of a flock printed matter. However, this process is disadvantageous in that the heating time is essentially prolonged since the dye shall penetrate or permeate through the hot melt adhesive onto the short fibers during the heating step. A further and more serious disadvantage of this process resides in that the resinous material used as the hot melt adhesive tends to adhere to the surfaces of the short fibers resulting in loss of comfortable touch which is the desired characteristic feature of the flocked textile and the resultant product has the appearance and feeling resembling to a non-woven fabric. Moreover, in case where a plurality of pile layers is transferred and adhered to a textile fabric, a delicate and time-consuming operation is required for the precise layout and arrangement of the patterns formed by said plurality of pile layers, otherwise a considerable amount of defective products is resulted.

OBJECTS AND SUMMARY OF THE INVENTION

An object of the present invention is, therefore, to provide a flock transfer sheet and a flock transfer printing process for producing a flock printed matter having a dyed pile layer of short fibers which is improved in feeling or touch and bright and deep in color.

Another object of the present invention is to provide a flock transfer sheet and a flock transfer printing process for producing a flock printed matter which is improved in fastness to light, fastnesses to rubbing and crocking, fastness to washing and fastness to dry cleaning and excellent in durability.

A further object of the present invention is to provide a flock transfer sheet and a flock transfer printing process for forming and fixing a pattern composed of a pile layer of short fibers very easily at a desired position on a blank stuff on which the pattern will be transferred.

A still further object of the present invention is to provide a flock transfer printing process in which a dyestuff is used but any troublesome after-treatments including the steaming and rinsing steps may be dispensed with and any pollution problems are not caused.

Yet a further object of the present invention is to provide a flock transfer sheet and a flock transfer printing process for printing and transferring a desired pattern without the need of complicated layout or registering operation.

Another object of the present invention is to provide a flock transfer sheet and a flock transfer printing process in which no disadvantageous halo and ghosting penomena occur at the heat-transferring step.

A further object of the present invention is to provide a flock transfer sheet and a flock transfer printing process for forming a multicolored pattern through simple and efficient operation steps.

A further object of the present invention is to provide a flock transfer sheet and a flock transfer printing process for reproducing a fine pattern precisely with ease.

The above and other objects of the present invention will become apparent from the following detailed description of the invention.

According to one aspect of the present invention, there is provided a flock transfer sheet comprising a heat-resistant base sheet, a pattern layer overlaid on said base sheet to form a pattern and containing a heat-sublimable or heat-vaporizable dye and a binder as main ingredients, a thickener layer overlaid on said pattern layer to cover at least said pattern and containing a water-soluble high polymer selected from the group consisting of cellulose derivatives, processed natural rubbers, processed starches, synthetic high polymers and sodium alignate as a main ingredient, a pile layer of short fibers electrostatically overlaid on said thickener layer and having dyeability to be dyed with said dye, and a hot melt adhesive layer overlaid on said pile layer for adhering to a matter to which the pattern is transferred, said base sheet being not substantially dyeable with said dye, said thickener layer being not substantially dyeable with said dye but having multiplicity of gas permeable micro-pores for allowing the dye to penetrate and pass therethrough when the dye is sublimated or vaporized by heating, said thickener layer being reduced in bonding strength to said pile layer to readily release said pile layer when heated, and said dye passing through said thickener layer and dyeing the short fibers of said pile layer to form a dyed pattern to be transferred onto said matter.

According to another aspect of the present invention there is provided a flock transfer printing process comprising the steps of:

(a) overlaying a pattern layer containing a heat-sublimable or heat-vaporizable dye and a binder as main ingredients on a heat-resistant base sheet which is not substantially dyeable with said dye to form a pattern to be transferred;

(b) forming at least on said pattern a thickener layer which allows a sublimated or vaporized dye to pass therethrough;

(c) electrostatically overlaying short fibers which are dyeable with said dye over said thickener layer to form a pile layer;

(d) heating to sublimate or vaporize the dye contained in said pattern layer for allowing the same to penetrate and pass through gas permeable micropores of said thickener layer without dyeing said thickener layer per se so that said short fibers of said pile layer are dyed with the dye passing through said thickener layer by vapor phase dyeing to form a dyed pattern to be transferred, and concurrently lowering the bonding strength of said thickener layer to said pile layer by heating;

(e) forming a hot melt adhesive layer over said pile layer thus dyed by vapor phase dyeing;

(f) applying said hot melt adhesive layer on a matter to be transferred with said pattern followed by heating to adhere said dyed pile layer to said matter through said adhesive layer; and (g) peeling said base sheet off from said pile layer at the interface between said pile layer and the thickener layer having been lowered in its bonding strength at the preceding heating step (d) to transfer the dyed flock print pattern to said matter to be transferred.

DESCRIPTION OF THE INVENTION

The present invention will now be described in detail with reference to the appended drawings.

Figure 1:
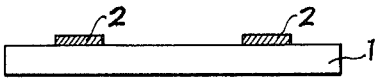
FIG. 1 is a schematic section showing the first step of the process for preparing a flock transfer sheet embodying the invention.

Firstly referring to FIG. 1, a desired pattern is drawn or printed on a base sheet 1 using one or more heat-sublimable or heat-voporizable dyes to form a pattern layer 2.

The mateials which may be used as the base sheet shall be heat-resistant and shall have a lesser affinity with the heat-sublimable or heat-vaporizable dye contained in the pattern layer 2 as the main ingredient. If the base sheet is made of a material which is inferior in heat resistant property and cannot withstand heat at the heating steps, satisfactory flock transfer sheet is not prepared. On the other hand, if the base sheet is made of a material which has an appreciable affinity with the used dye, the base sheet 1 tends to be dyed by the dye of itself to incur disadvantageous results in that the short fibers are unevenly dyed, leading to blurred appearance or in that color strength is lowered. It is desirous that the base sheet has smooth surfaces, uniform thickness and good printability. It is also preferred that the base sheet 1 has sufficient strength and thickness enough for holding the layers overlaid one after another thereon. Accordingly, it is desired that the basis weight of the base sheet 1 be 50 to 200 g/m$^2$, preferably 100 to 150 g/m$^2$. If the basis weight is less than 50 g/m$^2$, the strength is reduced too low to withstand the total weight of the laminated sheet. On the contrary, if the basis weight exceeds 200 g/m$^2$, transmission of heat at the heating step is hindered to make it difficult to sublimate or vaporaize the dye to effect dyeing. The material for the base sheet 1 is not particularly limited as far as it satisfies the aforementioned conditions, and wood-free paper and laminated paper composed of a paper layer and an aluminum foil or cellophane layer may be preferably used.

The heat-sublimable or heat-vaporizable dyes contained in the pattern layer 2 as the main ingredient may be selected from the disperse dyes which have been generally used for the heat transfer printing purpose. (In this connection, reference should be made to "American Dyestuff Reporter", 64, No. 2, 46 (1975).)

For example, the following dyes are suited for the production of the flock transfer sheet according to the invention:

Yellow Dye:

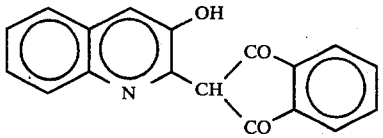

C.I. Disperse Yellow 54

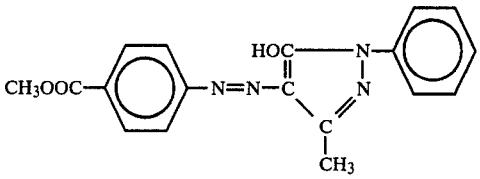

C.I. Disperse Yellow 60

Red Dye;

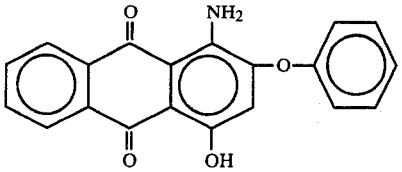

C.I. Disperse Red 60

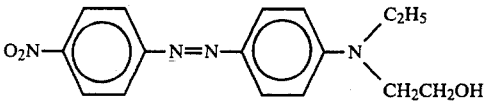

-continued

C.I. Disperse Red 1

Blue Dye;

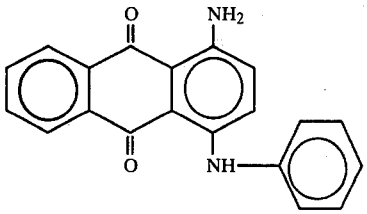

C.I. Disperse Blue 19

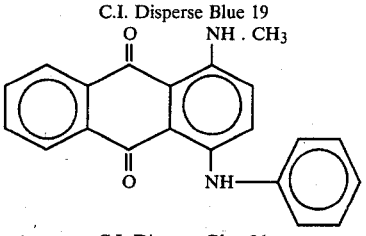

C.I. Disperse Blue 24

The pattern layer 2 contains a binder as the main ingredient other than the heat-sublimable or heat-vaporaizable dye. Ethyl cellulose, linseed oil varnishes, rosin modified phenolic resin varnishes, water-soluble acrylic resins and hydroxyethyl cellulose may be used as the binder. The thickness of the pattern layer 2 may range from 1 to 50 microns, preferably from 3 to 30 microns. If the thickness of the layer 2 is less than 1 micron, color strength of the flock transferred image may tend to be too feeble, whereas if the thickness exceeds 50 microns, there is a fear that a week fine line is thickened and the pattern becomes rather obscure due to the presence of excess dye.

The pattern layer 2 may be applied or printed on the base sheet 1, using, for example a printing ink prepared by dispersing a dye uniformly and finely in an ink vehicle, by means of almost all of practically employed printing processes including the screen printing process, the flexographic printing process, the gravure printing process, the offsetlithographic printing process and the letterpress printing process. The screen printing process is suited for the production of printed matters of high color strength or for the production of a small scale lot. The gravure printing process is suited for the production of fine gradation pattern and for the production of a large scale lot. The offset-tithographic printing process is advantageous over the gravure printing process in that it can produce a fine gradation pattern at a lower cost. In the present invention, the latterpress printing process can be applied to produce a printing matter of single color or multicolor by the use of a zinc line block, a copper halftone block, a photopolymer block or a rubber plate.

Figure 2A:
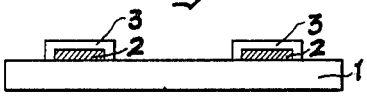
FIGS. 2*a* to 2*d* are schematic sections diagrammatically showing the steps for preparing the flock transfer sheet according to the invention.
Figure 3A:
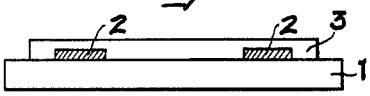
FIGS. 3*a* to 3*d* are schematic sections similar to those shown in FIGS. 2*a* to 2*d* but showing another embodiment of the flock transfer sheet according to the invention.

After overlaying the pattern layer 2 on the base sheet 1, a thickener layer 3 is coated on the pattern layer 2 so that the layer 2 is covered by the layer 3 as shown in FIG. 2*a*. The thickener layer 3 may be coated on the overall face of the base sheet 1 including the pattern layer 2, as shown in FIG. 3*a*.

It is important that the thickener layer 3 contains a water-soluble high polymer as the main ingredient. This water-soluble high polymer forms a film having a multiplicity of micro-pores to become gas-permeable, when dried, and allows the aforementioned bye to penetrate and pass therethrough while the dried film per se being left undyed. In order to further increase the number of micro-pores, it is preferred to use an oil-in-water emulsion prepared by dispersing uniformly and finely an organic solvent in an aqueous solution of water-soluble high polymer. Examples of organic solvent which may be used for this purpose are hydrocarbons such as mineral spirit, xylene, toluene and ethylbenzene. A porous material which has the least affinity with the aforementioned dye may be contained in the thickener, whereby the number of micropores is increased furthermore so that the dye can pass through the layer 3 easier.

Another important characteristic feature of the thickener layer 3 resides in that the bonding strength thereof to a pile layer 4 is lowered by heating to facilitate easy removal of the pile layer 4 after the subsequent transferring step, as will be described hereinafter. Examples of water-soluble high polymers which may be used as the main ingredient of the thickener layer 3 are cellulose derivatives such as hydroxyethyl cellulose, carboxymethyl cellulose and methyl cellulose, processed natural rubbers such as Maypro gum (Trade Name) and Indalca gum (Trade Name), processed starches such as Solvitose (Trade Name) and British gun, synthetic high polymers such as water-soluble acrylic resins and polyvinyl alcohol and natural substances such as sodium alginate. Particularly preferred are hydroxyethyl cellulose and water-soluble acrylic resins. Examples of porous materials are calcium carbonate, silica and alumina white. The mixing ratio of the porous material ranges 1 to 5 wt.% based on the total weight of the thickener including the weight of the mixed porous material, and preferable mixing ratio being 2 to 4 wt.%. A humectant or plasticizer may be added to the thickener for rendering the thickener soft, and the preferred materials for this purpose include glycols such a diethylene glycol, triethylene glycol and dipropylene glycol and glycerin.

The thickener layer 3 may be coated simply by the screen printing process, and the suitable amount of the layer 3 ranges from 10 to 90 g/m$^2$, preferably from 20 to 60 g/m$^2$, under wet condition, which corresponds to the solid content of from 3 to 27 g/m$^2$, preferably 6 to 18 g/m$^2$. If the amount is decreased out of the lower limit, there may arise a case where the pile layer 4 is hardly held. On the other hand, if the amount exceeds the upper limit, penetration of the dye may be hindered.

Figure 2B:
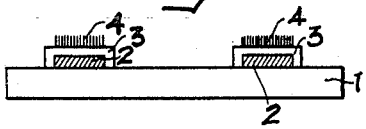
Figure 3B:
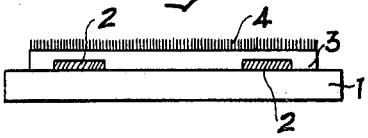

Then, as shown in FIGS. 2*b* and 3*b*, short fibers are electrostatically flocked on the coated thickener layer 3 to form the pile layer 4. In the embodiment shown in FIG. 2*b*, the pile layer 4 is overlaid only to cover the layer deposited with the pattern layer 2, since the thickener layer 3 covers only the pattern layer 2. In contrast thereto, the pile layer 4 is overlaid on the entire surface of the base sheet 1 in the embodiment shown in FIG. 3*b*, since the thickener layer 3 covers the overall surface of the base sheet 1. The electrostatic flocking operation is effected when the thickener layer 3 is still wet. The short fibers forming the pile layer 4 shall be dyeable with the aforementioned dye by means of vapor phase dyeing. Preferable short fibers are made of polyesters, 6, 6-nylon, cellulose triacetate and acrylic fibers. When generally evaluating in view of the color strength and the color fastness, short fibers of polyesters are the most excellent. It is desired that the length of short fibers be in the range of 0.3 to 2.0 mm, preferably 0.5 to 1.5 mm, and the fineness of fibers ranges desirously from 1.0 to 5.0 deniers, preferably from 1.25 to 3.0 deniers. If the length of short fibers is less than 0.3 mm, there arises a fear that the resultant flock printed matter loses the touch or feeling of flocked fabric. On the other hand, if the length exceeds 2.0 mm, there arises a fear that the resultant product is not suited for use as clothing goods. In case where the fineness is less than 1.0 denier, the short fibers of too thin fineness tends to be entangled with each other. On the contrary, the coarser fibers having the fineness exceeding 5.0 deniers deteriorate the feeling.

It is recommendable that the electrostatic flock operation is carried out by applying an electric potential of from 30,000 to 35,000 volts between the electrode plates spaced by 60 to 100 mm and by vibrating the sheet at a vibration cycle of 50 to 200 cycles/min. It is also recommendable that the thickener layer overlaid on the base sheet is slowly dried at a temperature of from 40° to 90° C., preferably from 50° to 80° C., for 1 to 3 hours, preferably 1.5 to 2.0 hours, after the pile layer 4 has been formed.

Figure 2C:
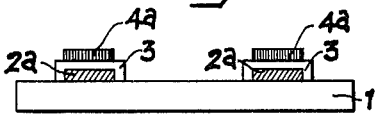
Figure 3C:
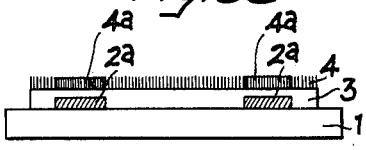

Then, the dye contained in the pattern layer 2 is sublimated or vaporized by heating to allow the dye to penetrate and pass through the gas permeable micro-pores of the thickener layer 3 to dye the short fibers by vapor phase dyeing, and concurrently the bonding strength between the thickener layer 3 and the pile layer 4 is lowered. It is a normal practice to effect vapor phase dyeing by heating at 170° to 205° C. under atmospheric pressure for 15 to 120 seconds. In general, this heat treatment is desirously effected under the minimum pressure using a heat transfer press which is commonly used in the heat transfer printing process in order not to collapse the short fibers by the compressive action of the heat plates. The sublimation or vaporization operation for effecting vapor phase dyeing of the short fibers may be carried out under reduced pressure, whereby the feeling of the finished product becomes softer than that of the product obtained by heating at atmospheric pressure, since the dyeing operation can be carried out at a lower temperature for a shorter period of processing time. For instance, the short fibers may be dyed at 170° to 190° C. under a reduced pressure of 5 to 30 Torr for 15 to 90 seconds. The pattern layers 2*a* from which the dyes have been sublimated or vaporized and the pile layers 4*a* which have been dyed are shown in FIGS. 2*c* and 3*c*.

A hot melt adhesive layer 5 is formed on the pile layer 4*a* which has been dyed by vapor phase dyeing. An adhesive paste containing a synthetic resin emulsion or synthetic rubber latex is firstly coated on and registered with the dyed pile layer 4*a*, and a hot melt adhesive is applied thereon by powdering or coating, when the adhesive paste is still wet, followed by drying to form the hot melt adhesive layer 5. Emulsions of polyacrylic esters, polyvinyl acetate and polyvinyl chloride may be generally used as the synthetic resin emulsion, and synthetic rubber latices may also be used. The viscosity of any of these emulsions or latices may be increased to have appropriate viscosity, optionally by adding with a suitable cross-linking agent, such as a water-soluble melamine resin, to prepare an adhesive paste which may be coated on the dyed pile layer 4*a* by means of the screen printing process or other suitable process.

Examples of the hot melt adhesive which may be preferably used in the present invention are resins such as polyethylene, polyamides, ethylene-vinyl acetate copolymers, polyvinyl chloride and polyesters. Polyamide resins are particularly preferred, since the flock printed products obtained by the use of the polyamide resins have soft feelings and are excellent in bonding strength, fastness to washing and fastness to dry cleaning.

Figure 2D:
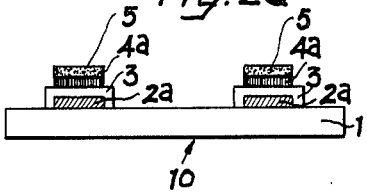
Figure 3D:
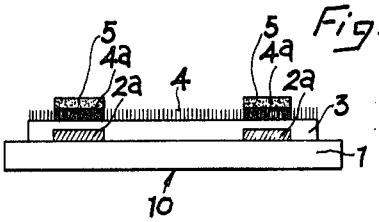

It is desired that the amount of the coated hot melt adhesive layer ranges from 20 to 100 g/m$^2$, preferably 40 to 80 g/m$^2$. If the amount is less than 20 g/m$^2$, the bonding strength is adversely affected. On the other hand, if the amount is so large as exceeding 100 g/m$^2$, the touch or feeling of the flock transfer printed matter is deteriorated due to the presence of excess adhesive. Following to the procedures as described hereinabove, the flock transfer sheet 10 according to the present invention is prepared. (See FIGS. 2*d* and 3*d*.)

Figure 4A:
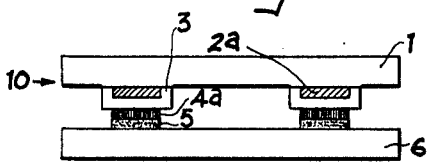
FIGS. 4*a* and 4*b* are schematic sectons diagrammatically showing the process for transferring the pattern or image from the flock transfer sheet prepared by the steps shown in FIGS. 2*a* to 2*d* to the stuff on which the pattern is transferred.
Figure 5A:
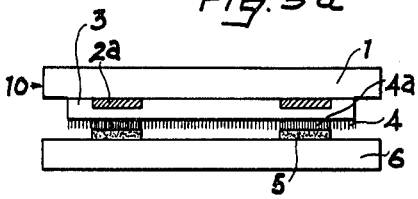
FIGS. 5*a* and 5*b* are schematic sections diagrammatically showing the process for transferring the pattern or image from the flock transfer sheet prepared by the steps shown in FIGS. 3*a* to 3*d* to the stuff on which the pattern is transferred.
Figure 4B:
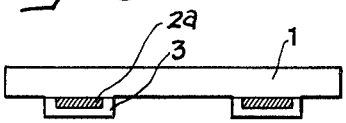
Figure 5B:
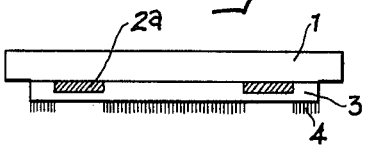
Figure 5B:
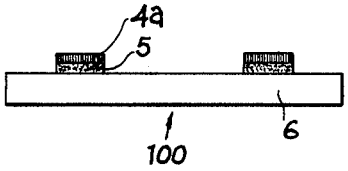
Figure 5B:
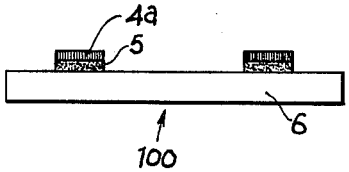

FIGS. 4*a* and 5*a* show the operations for transferring the pile layers 4*a* of the flock transfer sheets 10 to the blank matters 6 on which the patterns are transferred. The flock transfer sheet 10 is overlaid on the blank matter 6 and heated to 80° to 170° C. under a pressure of 10 to 500 g/cm$^2$ for 10 to 40 seconds in the general transferring operation. As shown in FIGS. 4*b* and 5*b*, the dyed pile layer 4*a* is peeled off from the thickener layer 3 at the final step to give the finished flock transfer printed matters 100. The blank stuffs which may be commonly used as the matters 6 to be transferred with the pattern include woven and knitted fabrics of cotton, hemp, linen, wool, silk, rayon, acetate, polyesters, polyamides, polyacrylic fibers and blended yard fabrics thereof, and nonwoven fabrics, metals, woods, leathers, glasses and plastics may also be used.

EXAMPLES OF THE INVENTION

The present invention will be further described in detail by referring to some examples thereof. Parts appearing in the following examples mean "parts by weight".

EXAMPLE 1

A sheet of wood-free paper having a basis weight of 120 g/m$^2$ was used as the base paper sheet on which a two color pattern was printed using water-in-oil emulsion ink as set forth below by means of a sheet-fed screen printing machine. The pattern was left standing for drying to form a pattern layer having an average thickness of 20 microns.

| Composition of Ink: | Yellow Ink (parts) | Red Ink (parts) |
|---|---|---|
| C.I. Disperse Yellow 54 (Quinophthalone Dye) | 5 | — |
| C.I. Disperse Red 60 (Anthraquinone Dye) | — | 6 |
| 10% Ethyl Cellulose Solution* | 30 | 30 |
| Mineral Spirit | 25 | 24 |
| Water | 40 | 40 |
| | 100 | 100 |

| *Note: 10% Ethyl Cellulose Solution | |
|---|---|
| Ethyl Cellulose | 10 |
| n-Butyl Alcohol | 10 |
| Mixed Xylene | 80 |
| | 100 |

Then, the thickener set forth below was coated on the pattern layer by the screen printing process and registering the same with the contour of the pattern layer to form a thickener layer having a dried weight of 10 g/m$^2$.

| Composition of Thickener: | (parts) |
|---|---|
| O/W Type Emulsion Reducer No. 1* | 60 |
| 3% Hydroxyethyl Cellulose (HEC) (Aq. Solution) | 32 |
| Silica Gel | 3 |
| Diethylene Glycol | 5 |
| Total: | 100 |

| *Note: O/W Type Emulsion Reducer No. 1 | (parts) |
|---|---|
| Non-ionic Emulsifier (Mixture of Polyoxyethylene Alkyl Ether and Polyoxyethylene Fatty Acid Ester) | 5 |
| 20% Aqueous Solution of Water-soluble Acrylic Resin | 45 |
| Mineral Turpentine | 50 |
| | 100 |

Polyester short fibers having the fineness of 1.5 deniers and the length of 0.5 mm were electrostatically flocked on the base sheet having the pattern layer and the thickener layer as set forth above, which was then dried at 80° C. for one hour to form a pile layer having a plane contour coincident with that of the aforementioned pattern layer.

The base sheet having the pattern layer, the thickener layer and the pile layer obtained by the preceding steps was charged into a heat transfer platen press and held therein at 190° C. for 60 seconds while applying with the minimum pressure so that the pile was only slightly compressed by hot pressure plates of the heat transfer platen press, whereupon the dyes contained in the pattern layer were sublimated or vaporized to pass through the thickener layer to the pile layer where the short fibers were dyed by vapor phase dyeing. Concurrently, the bonding strength of the thickener layer was lowered by heating.

The emulsion of acrylic resin having the composition as set forth below was coated on the thus dyed pile layer in the pattern coextensive with the contour of the dyed pile layer by means of the screen printing process.

| Composition of Emulsion: | (parts) |
|---|---|
| Ammonia Thickening and Reactive Acrylic Emulsion (Solid Content: 40%) | 96 |
| 28% Aqueous Ammonia | 1 |
| Water-Soluble Melamine Resin (Cross-Linking Agent) | 3 |
| | 100 |

A polyamide resin powder (Melting Range: 110–120° C.; particle size: 200 meshes) was added by powdering using an electrostatic flocking apparatus on said emulsion composition of acrylic resin coated on the dyed pile layer before the emulsion was not yet dried, and then the emulsion layer was dried to form a hot melt adhesive layer having a thickness of 62 g/m$^2$ on the dyed pile layer. The thus prepared flock transfer sheet was applied on a pre-set position of a T-shirt made of a cotton fabric, and subjected to heat treatment at 160° C. for 20 seconds under a pressure of 100 g/m$^2$ using an iron. The base sheet was peeled off from the T-shirt to obtain a flock printed T-shirt printed with a color pattern of bright and deep yellow and pink.

The color fastnesses of the thus flock printed T-shirt are shown in the following Table.

| Color Fastness | Evaluation | Test Method |
|---|---|---|
| Fastness to Light | 6 | AATCC 16A-1977 |
| Fastness to Washing | 4 | AATCC 61-1975 IIA |
| Fastness to Dry Cleaning | 4 | AATCC 132-1976 |

EXAMPLE 2

A sheet of wood-free paper having a basis weight of 110 g/m$^2$ was used as the base paper sheet on which a two color gradation pattern was printed using the offset printing ink as set forth below by means of a sheet-fed screen printing machine. The pattern was left standing for drying to form a pattern layer having an average thickness of 4 microns.

| Composition of Ink: | Red Ink (parts) | Blue Ink (parts) |
|---|---|---|
| C.I. Disperse Red 1 (Azo Dye) | 25 | — |
| C.I. Disperse Blue 19 (Anthraquinone Dye) | — | 27 |
| Bodied Linseed Oil Varnish | 40 | 30 |
| Rosin-modified Phenolic Resin Varnish | 29 | 37 |
| Cobalt Naphthenate Drier | 1 | 1 |
| Mineral Oil (Boiling Range: 280-300° C.) | 5 | 5 |
| | 100 | 100 |

Then, the thickener set forth below was coated on the overall surface of the base sheet by the screen printing process to form a thickener layer having a thickness of dried weight of 12 g/m$^2$.

| Composition of Thickener: | (parts) |
|---|---|
| O/W Type Emulsion Reducer No. 2* | 25 |
| 5% Aqueous Solution of Hydroxyethyl Cellulose (HEC) | 70 |
| Diethylene Glycol | 5 |
| | 100 |

| *Note: O/W Type Emulsion Reducer No. 2 | (Parts) |
|---|---|
| Non-ionic Emulsifier (The Same as Used in Example 1) | 5 |
| Silica Gel | 5 |
| 20% Aqueous Solution of Water-soluble Acrylic Resin | 40 |
| Mineral Turpentine | 50 |
| | 100 |

Polyester short fibers having the fineness of 1.5 deniers and the length of 0.8 mm were electrostatically flocked on the entire surface of the base sheet having the pattern layer and the thickener layer as described hereinabove, and dried at 80° C. for one hour to form a pile layer over the entire surface of the base sheet including the pattern layer. The following procedures were similar as in Example 1 except in that an ethylene-vinyl acetate copolymer is used as the hot melt adhesive to prepare a flock transfer sheet. The flock transfer sheet was obtained, the colors of which were bright and excellent in reproducibility of graduation pattern. Similarly as in Example 1, the pattern was transferred from the thus prepared flock transfer sheet to a shirt made of a blended yarn fabric of polyester and cotton to obtain a flock printed shirt. The color fastnesses of the thus obtained flock printed shirt were as follows:

| | |
|---|---|
| Fastness to Light: | Grade 4 |
| Fastness to Washing: | Grade 4 |
| Fastness to Dry Cleaning: | Grade 2 |

EXAMPLE 3

A sheet of wood-free paper having a basis weight of 120 g/m$^2$ was used as the base paper sheet on which a two color line pattern was printed using the same offset printing ink as used in Example 2 by means of a letter-press printing machine to form a pattern layer having an average thickness of 8 microns.

Then, following to the procedures similarly as in Example 1, a thickener layer (Dry Weight: 15 g/m$^2$) and a pile layer (Length: 1.2 mm; Fineness: 1.5 deniers) were formed on the pattern layer. The thus formed laminated sheet was charged into a vacuum heat transfer press and held at 180° C. under a reduced pressure of 10 Torr for 60 seconds, whereby the pile layer was dyed by vapor phase dyeing.

The following procedures were similar as in Example 1 to prepare a flock transfer sheet. A flock transfer sheet having a clear line pattern was obtained. Using this transfer sheet, the pattern was transferred to a hemp fabric to produce a flock printed fabric. The color fastnesses of the thus produced flock printed fabric were as follows:

| | |
|---|---|
| Fastness to Light: | Grade 4 |
| Fastness to Washing: | Grade 4 |
| Fastness to Dry Cleaning: | Grade 4 |

EXAMPLE 4

On a sheet of wood-free paper having a basis weight of 100 g/m$^2$ printed was a three color photographic pattern using the gravure printing ink having the composition as set forth below by means of a gravure rotary press to form a pattern layer having an average thickness of 12 microns.

| Composition of Ink: | Yellow Ink (parts) | Red Ink (parts) | Blue Ink (parts) |
|---|---|---|---|
| C.I. Disperse Yellow 60 (Azo Dye) | 7 | — | — |
| C.I. Disperse Red 60 (Anthraquinone Dye) | — | 8 | — |
| C.I. Disperse Blue 24 (Anthraquinone Dye) | — | — | 9 |
| Ethyl Cellulose Varnish No. 1* | 93 | 92 | 91 |
| | 100 | 100 | 100 |

| *Note: Ethyl Cellulose Varnish NO. 1 | (Parts) |
|---|---|
| Ethyl Cellulose N-50 | 5 |
| Iso-propyl Alcohol | 20 |
| Toluene | 60 |
| Ethyl Acetate | 15 |
| | 100 |

Then, following to the procedures similarly as in Example 1, a thickener layer (Dry Weight: 18 g/m$^2$) and a pile layer (Length: 1.0 mm; Fineness: 1.3 deniers) were formed on the pattern layer. The thus formed laminated sheet was charged into a vacuum heat transfer press and held at 185° C. under a reduced pressure of 15 Torr for 70 seconds, whereby the pile layer was dyed by vapor phase dyeing.

The following procedures were similar as in Example 1 to prepare a flock transfer sheet. A flock transfer sheet was obtained, which was excellent in reproducibility of the photographic pattern. Using this transfer sheet, the pattern was transferred to a rayon fabric. The color-fastnesses of the thus produced flock printed fabric were as follows:

| | |
|---|---|
| Fastness to Light: | Grade 4–6 |
| Fastness to Washing: | Grade 4 |
| Fastness to Dry Cleaning: | Grade 4 |

EXAMPLE 5

On a sheet of kraft paper having a basis weight of 120 g/m$^2$ printed was a two color line pattern using the flexographic ink as set forth below by means of a flexographic press to form a pattern layer having an average thickness of 10 microns.

| Composition of Ink: | Yellow Ink (parts) | Blue Ink (parts) |
|---|---|---|
| C.I. Disperse Yellow 54 (Quinophthalone Dye) | 11 | — |
| C.I. Disperse Blue 19 (Anthraquinone Dye) | — | 12 |
| Ethyl Cellulose Varnish No. 2* | 89 | 88 |
| | 100 | 100 |

| Note: | Ethyl Cellulose Varnish No. 2 | (parts) |
|---|---|---|
| | Ethyl Cellulose N-7 | 6 |
| | Iso-propyl Alcohol | 70 |
| | Ethyl Acetate | 15 |
| | Ethylene Glycol Monoethyl Ether | 9 |
| | | 100 |

Then, following to the procedures same as in Example 1, a flock transfer sheet was prepared. A flock transfer sheet having a pattern of clear image was obtained. The pattern was transferred to a plain gauze of polyester similarly as in Example 1. The color fastnesses of the thus produced flock printed matter were as follows:

| | |
|---|---|
| Fastness to Light: | Grade 4–6 |
| Fastness to Washing: | Grade 4 |
| Fastness to Dray Cleaning: | Grade 4 |

EXAMPLE 6

A flock transfer sheet was prepared similarly as in Example 1 except in that a low density polyethylene was used in place of the polyamide resin to form a hot melt adhesive layer of 28 g/m$^2$. The pattern was transferred from this transfer sheet to a training wear made of a knitted acrylic fabric. The conditions for transferring and the color fastnesses of the resulting printed matter were as follows:

Conditions for Transferring

Temperature: 90° C.
Time Period: 12 seconds
Pressure: 10 g/cm$^2$

Color Fastness

| | |
|---|---|
| Fastness to Light: | Grade 6 |
| Fastness to Washing | Grade 4 |

-continued

| | |
|---|---|
| Fastness to Dry Cleaning: | Grade 2 |

Although the present invention has been described by referring to specific examples and embodiments thereof, it is not intended to limit the present invention only to the specifically disclosed embodiments and examples but the present invention may be modified or changed without departing from the spirit thereof, accordingly the scope of the present invention shall be defined only by the appended claims.

What is claimed is:

1. A flock transfer sheet comprising a heat-resistant base sheet, a pattern layer overlaid on said base sheet to form a pattern and containing a heat-sublimable or heat-vaporizable dye and a binder as main ingredients, a thickener layer overlaid on said pattern layer to cover at least said pattern and containing as a main ingredient a water-soluble high polymer selected from the group consisting of cellulose derivatives, processed natural rubbers, processed starches, synthetic high polymers and sodium alginate, a pile layer of short fibers electrostatically overlaid on said thickener layer and having dyeability to be dyed with said dye, and a hot melt adhesive layer overlaid on said pile layer for adhering to a matter to which the pattern is transferred, said base sheet being not substantially dyeable with said dye, said thickener layer being not substantially dyeable with said dye but having multiplicity of gas permeable micropores for allowing the dye to penetrate and pass therethrough when the dye is sublimated or vaporized by heating, said thickener layer being reduced in bonding strength to said pile layer to readily release said pile layer when heated, and said dye passing through said thickener layer and dyeing the short fibers of said pile layer to form a dyed pattern to be transferred onto said matter.

2. A flock transfer sheet according to claim 1, wherein said thickener layer is formed by coating an oil-in-water emulsion obtained by dispersing uniformly and finely an organic solvent in an aqueous solution of said water-soluble high polymer.

3. A flock transfer sheet according to claim 2, wherein said organic solvent is selected from the group consisting of mineral spirit, xylene, toluene and ethylbenzene.

4. A flock transfer sheet according to claim 1 or 2, wherein said thickener layer contains porous particles which are not dyeable with said dye.

5. A flock transfer sheet according to claim 1, wherein said thickener layer contains porous particles which are not dyeable with said dye, and the content of said porous particles ranges from 1 to 5 wt.% based on the weight of said thickener layer.

6. A flock transfer sheet according to claim 5, wherein said porous particles are made of a compound selected from the group consisting of calcium carbonate, silica and alumina white.

7. A flock transfer sheet according to claim 1, wherein said water-soluble high polymer is selected from the group consisting of hydroxyethyl cellulose, carboxymethyl cellulose, methyl cellulose, processed natural rubbers, processed starches, water-soluble acrylic resins, polyvinyl alcohol and sodium alginate.

8. A flock transfer sheet according to claim 1, wherein a humectant or plasticizer selected from the group consisting of diethylene glycol, triethylene glycol, dipropylene glycol and glycerin is contained in said thickener layer.

9. A flock transfer sheet according to claim 1, wherein said thickener layer amounts to 10 to 90 g/m$^2$ under wet condition and 3 to 27 g/m$^2$ as solid content.

10. A flock transfer sheet according to claim 1, wherein the basis weight of said base sheet is 50 to 200 g/m$^2$.

11. A flock transfer sheet according to claim 1, wherein said heat-sublimable or heat-vaporizable dye is composed of one or more dyes selected from the group consisting of the dyes set forth below as represented by respective chemical formulae of:

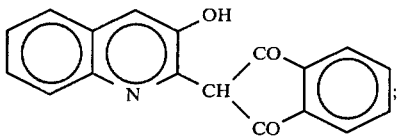

C.I. Disperse Yellow 54

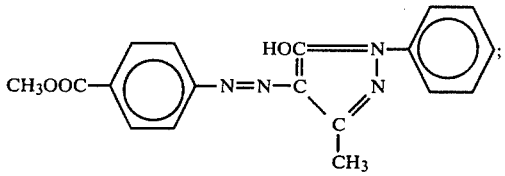

C.I. Disperse Yellow 60

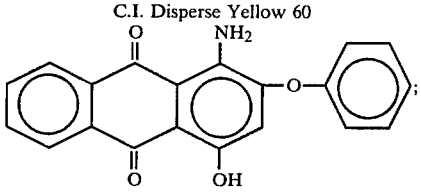

C.I. Disperse Red 60

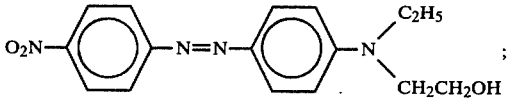

C.I. Disperse Red 1

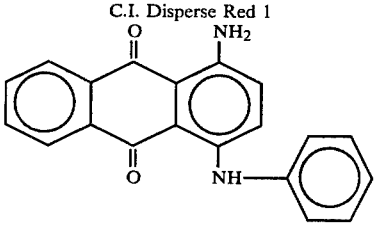

C.I. Disperse Blue 19; and

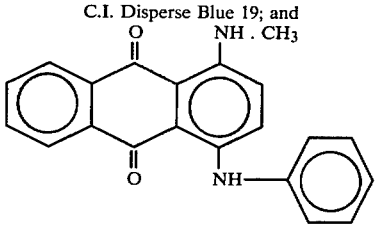

C.I. Disperse Blue 24

12. A flock transfer sheet according to claim 1, wherein said binder is selected from the group consisting of ethyl cellulose, linseed oil varnishes, rosin-modified phenolic resin varnishes, water-soluble acrylic resins and hydroxyethyl cellulose.

13. A flock transfer sheet according to claim 1, wherein the thickness of said pattern layer ranges from 1 to 50 microns.

14. A flock transfer sheet according to claim 1, wherein said short fibers are made of a material selected from the group consisting of polyester fibers, 6,6-nylon, cellulose triacetate and acrylic fibers.

15. A flock transfer sheet according to claim 1, wherein the lengths of said short fibers range from 0.3 to 2.0 mm and the finenesses thereof range from 1.0 to 5.0 deniers.

16. A flock transfer sheet according to claim 1, wherein said hot melt adhesive layer is made of a material selected from the group consisting of polyethylene, polyamides, ethylene-vinyl acetate copolymers, polyvinyl chloride and polyesters.

17. A flock transfer sheet according to claim 1, wherein said hot melt adhesive layer amounts to 20 to 100 g/m$^2$.

18. A flock transfer printing process comprising the steps of:

(a) overlaying a pattern layer containing a heatsublimable or heat-vaporizable dye and a binder as main ingredients on a heat-resistant base sheet which is not substantially dyeable with said dye to form a pattern to be transferred;

(b) forming at least on said pattern layer a thickener layer which allows a sublimated or vaporized dye to pass therethrough;

(c) electrostatically overlaying short fibers which are dyeable with said dye over said thickener layer to form a pile layer;

(d) heating to sublimate or vaporize the dye contained in said pattern layer for allowing the same to penetrate and pass through gas permeable micropores of said thickener layer without dyeing said thickener layer per se so that said short fibers of said pile layer are dyed with the dye pasing through said thickener layer by vapor phase dyeing to form a dyed pattern to be transferred, and concurrently reducing the bonding strength of said thickener layer to said pile layer by heating;

(e) forming a hot melt adhesive layer over said pile layer thus dyed by vapor phase dyeing;

(f) applying said hot melt adhesive layer on a matter to be transferred with said pattern followed by heating to adhere said dyed pile layer to said matter through said adhesive layer; and (g) peeling said base sheet off from said pile layer at the interface between said pile layer and the thickener layer having been reduced in bonding strength at the preceding heating step (d) to transfer the dyed flock print pattern to said matter to be transferred.

19. A flock transfer printing process according to claim 18, wherein said pattern layer is formed at said step (a) by printing the pattern layer with a printing ink containing said dye dispersed finely in an ink vehicle.

20. A flock transfer printing process according to claim 19, wherein said printing is effected by means of a printing method selected from the group consisting of screen printing process, flexographic printing process, gravure printing process, offset-lithographic printing process and letterpress printing process.

21. A flock transfer printing process according to claim 18, wherein said thickener layer is coated at said step (b) so that it covers only the pattern formed by said pattern layer.

22. A flock transfer printing process according to claim 18, wherein said thickener layer is coated at said step (b) so that it covers the entire face of said base sheet including said pattern layer.

23. A flock transfer printing process according to claim 18, wherein said short fibers are overlaid or flocked at said step (c) by applying an electric potential of from 30,000 to 35,000 volts between the electrode plates spaced by 60 to 100 mm and by vibrating the sheet at a vibration cycle of 50 to 200 cycles/min.

24. A flock transfer printing process according to claim 18, further comprising the step of drying said thickener layer at 40° to 90° C. for 1 to 3 hours after the step (c) of forming said pile layer.

25. A flock transfer printing process according to claim 18, wherein the heating at said step (d) is effected at 170° to 205° at atmospheric pressure for 15 to 120 seconds.

26. A flock transfer printing process according to claim 18, wherein the heating at said step (d) is effected at 170° to 190° C. under a reduced pressure of from 5 to 30 Torr for 15 to 90 seconds.

27. A flock transfer printing process according to claim 18, wherein said hot melt adhesive layer is formed at said step (e) firstly by coating an adhesive paste on said dyed pile layer and further coating said hot melt adhesive.

28. A flock transfer printing process according to claim 18, wherein the heating at said step (f) is effected at 80° to 170° C. under a pressure of from 10 to 500 g/cm$^2$ for 10 to 40 seconds.

* * * * *